US009518353B2

(12) United States Patent
Joo

(10) Patent No.: US 9,518,353 B2
(45) Date of Patent: Dec. 13, 2016

(54) METHOD FOR CONTROLLING DRUM TYPE WASHING MACHINE

(71) Applicant: Dongbu Daewoo Electronics Corporation, Seoul (KR)

(72) Inventor: Sung Su Joo, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 328 days.

(21) Appl. No.: 14/168,855

(22) Filed: Jan. 30, 2014

(65) Prior Publication Data

US 2015/0176168 A1 Jun. 25, 2015

(30) Foreign Application Priority Data

Dec. 24, 2013 (KR) ..... 10-2013-0162521

(51) Int. Cl.

| | |
|---|---|
| ***D06F 58/28*** | (2006.01) |
| ***D06F 58/24*** | (2006.01) |
| ***D06F 25/00*** | (2006.01) |
| ***D06F 33/02*** | (2006.01) |

(52) U.S. Cl.

CPC ..... *D06F 58/28* (2013.01); *D06F 58/24* (2013.01); *D06F 25/00* (2013.01); *D06F 33/02* (2013.01); *D06F 2058/2896* (2013.01); *D06F 2204/086* (2013.01)

(58) Field of Classification Search

CPC ..... D06F 2058/2896; D06F 2204/086; D06F 25/00; D06F 33/02; D06F 58/24

See application file for complete search history.

(56) References Cited

U.S. PATENT DOCUMENTS 1,243,647 A * 10/1917 Whittelsey ..... G05D 23/185 123/552
3,212,563 A * 10/1965 Schrader ..... H01F 27/16 165/108
3,323,335 A * 6/1967 Schneider ..... D06F 43/081 68/18 R (Continued)

FOREIGN PATENT DOCUMENTS

| | | |
|---|---|---|
| CN | 202830575 U | 3/2013 |
| EP | 2554740 | 2/2013 |
| EP | 2554740 A2 | 2/2013 |
| KR | 10-2006-0057779 A | 5/2006 |

(Continued)

OTHER PUBLICATIONS

The extended European Search Report dated Jun. 10, 2015, issued in corresponding European Patent Application No. 14177055.2.

(Continued)

*Primary Examiner* — Kenneth Rinehart
*Assistant Examiner* — Logan Jones

(57) ABSTRACT

A method for controlling a drum type washing machine including a condensing duct configured to receive air from a tub, the method including supplying a first coolant into a storage unit in the condensing duct holding or maintain the first supply of the coolant in the storage unit; and supplying a second coolant into the storage unit after a preset or predetermined time period elapses is provided. The preset time period is shorter by a predetermined time length than an expected time period for thermal equilibrium between the coolant in the storage unit and the air in the condensing duct.

14 Claims, 9 Drawing Sheets

(56) References Cited

U.S. PATENT DOCUMENTS

| | | | | |
|---|---|---|---|---|
| 3,575,193 | A * | 4/1971 | Niewyk | D06F 33/02 137/119.01 |
| 4,154,003 | A * | 5/1979 | Muller | D06F 58/24 34/469 |
| 6,363,755 | B1 * | 4/2002 | Hapke | D06F 37/42 210/146 |
| 7,421,865 | B2 * | 9/2008 | Lee | D06F 25/00 68/15 |
| 2006/0107706 | A1 * | 5/2006 | Cho | D06F 25/00 68/18 C |
| 2006/0179896 | A1 * | 8/2006 | Lim | D06F 37/26 68/20 |
| 2007/0033970 | A1 * | 2/2007 | Lee | D06F 58/24 686/19.2 |
| 2013/0031798 | A1 * | 2/2013 | Bae | D06F 58/28 34/469 |

FOREIGN PATENT DOCUMENTS

| | | |
|---|---|---|
| KR | 10-2007-0064017 | 6/2006 |
| KR | 10-2013-0018466 A | 2/2013 |

OTHER PUBLICATIONS

Korean Office Action dated Apr. 14, 2015 issued in corresponding Korean patent application No. 10-2013-0162521.
Korean Patent Abstracts, Publication No. 10-2007-0064017, Published Jun. 20, 2006, KIPO, Republic of Korea.
European Office Action dated May 17, 2016 issued in corresponding European Patent Application No. 14177055.2.

* cited by examiner

A FIRST TIME PERIOD: A TIME PERIOD EXPECTED TO BE TAKEN BEFORE THE COOLANT IN THE STORAGE AFTER THE FIRSTLY SUPPLYING OF THE COOLANT COMES INTO THERMAL EQUILIBRIUM WITH THE AIR IN THE CONDENSING DUCT

A SECOND TIME PERIOD: A TIME PERIOD A PREDETERMINED TIME LENGTH SHORTER THAN THE FIRST TIME PERIOD

*FIG. 9*

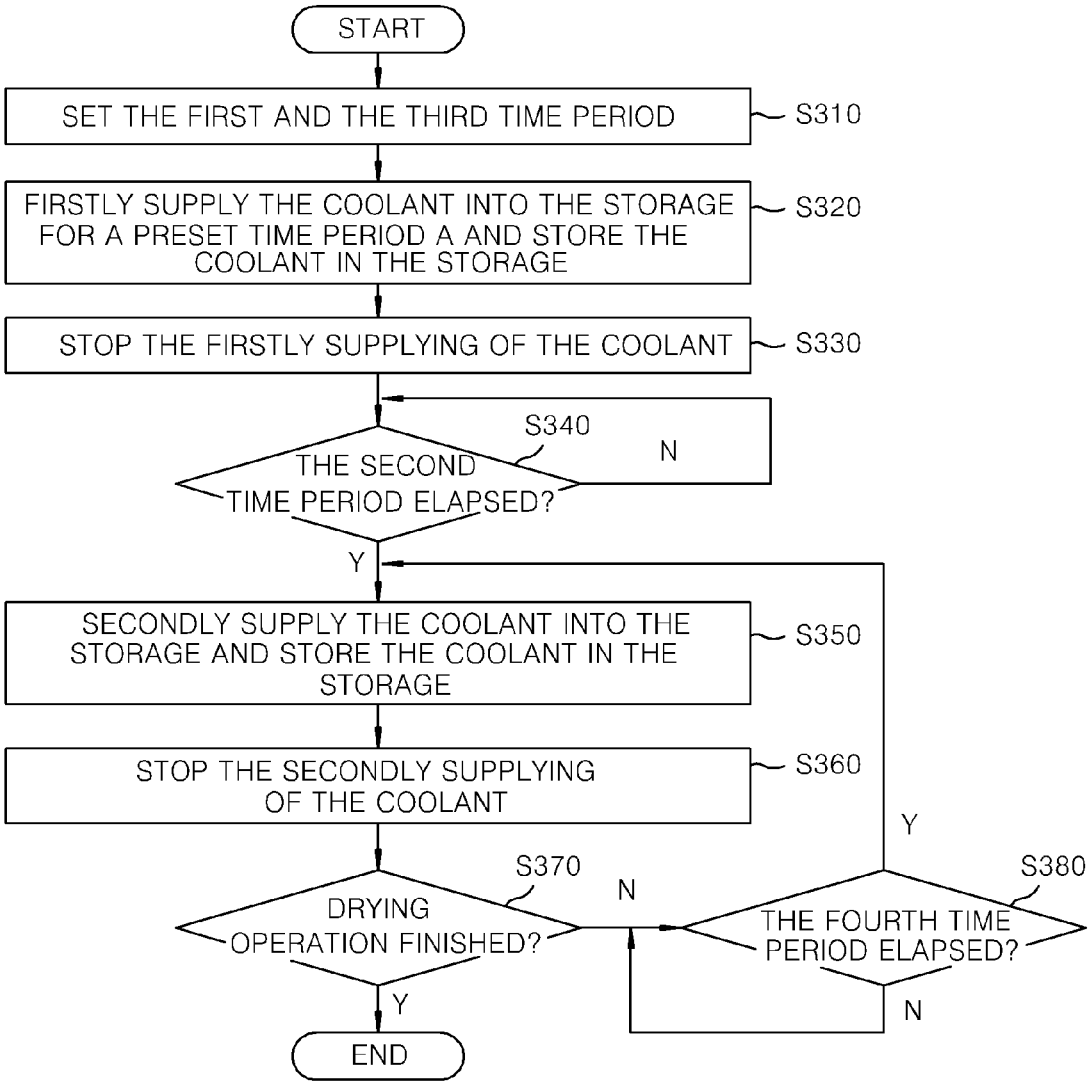

A FIRST TIME PERIOD: A TIME PERIOD EXPECTED TO BE TAKEN BEFORE THE COOLANT IN THE STORAGE AFTER THE FIRSTLY SUPPLYING OF THE COOLANT COMES INTO THERMAL EQUILIBRIUM WITH THE AIR IN THE CONDENSING DUCT

A SECOND TIME PERIOD: A TIME PERIOD A PREDETERMINED TIME LENGTH SHORTER THAN THE FIRST TIME PERIOD

A THIRD TIME PERIOD: A TIME PERIOD EXPECTED TO BE TAKEN BEFORE THE COOLANT IN THE STORAGE AFTER THE SECONDLY SUPPLYING OF THE COOLANT COMES INTO THERMAL EQUILIBRIUM WITH THE AIR IN THE CONDENSING DUCT

A FOURTH TIME PERIOD: A TIME PERIOD A PREDETERMINED TIME LENGTH SHORTER THAN THE THIRD TIME PERIOD

METHOD FOR CONTROLLING DRUM TYPE WASHING MACHINE

CROSS-REFERENCE TO RELATED APPLICATIONS

This application is based on and claims priority from Korean Patent Application No. 10-2013-0162521, filed on Dec. 24, 2013, the disclosure of which is incorporated herein in its entirety by reference.

TECHNICAL FIELD

The present disclosure relates to a method for controlling a washing machine, and more particularly, to a method for controlling a drum type washing machine to improve a drying function.

BACKGROUND

In general, a drum type washing machine washes laundry using a force that is generated when the laundry is raised by a lifter and then is dropped down as the drum rotates. The advantages of this drum type washing machine include less damage to the clothing due to less friction, and consumption of less water due to water being primarily at the bottom of the drum.

The drum type washing machine includes a cabinet that forms the exterior of the washing machine; a tub in the cabinet that accommodates water therein; a rotary drum in the tub that holds laundry therein; a motor in, behind or under the tub that provides a motive power to the drum; a water supply device that supplies water to the tub; and a drain that drains the water from the tub to the outside of the cabinet after the washing process is completed.

A detergent case may be at one side of the cabinet, and a water supply pipe may supply water to the tub through the detergent case. As water is supplied through the water supply pipe by the water supply device, detergent in the detergent case is also supplied to the tub along with the water.

A circulation duct for drying the laundry may be at one side of the tub. The circulation duct may have incorporate therein a fan configured to circulate air in the tub; a condensing device configured to condense moisture in the air; and a heating device configured to heat the air after the condensing process. Once the drying process has begun, the air in the tub is brought into the circulation duct by the fan. The air brought into the circulation duct may be subjected to a condensing process for eliminating moisture from the air by the condensing device, and the air may then be heated by the heating device.

Conventionally, the condensing device includes a nozzle at an upper side of the circulation duct, configured to jet coolant directly to the inside of the circulation duct. The coolant from the upper side of the circulation duct freely falls down along the circulation duct, while contacting the air, and lowers the temperature of the ambient air around the circulation duct and/or condenses the moisture in the air flowing in the circulation duct into water droplets. The water droplets may also fall down along the circulation duct and be collected in a separate condensed water tray.

In such a conventional washing machine, moisture can be substantially condensed only for the time during which the jetted coolant actually passes through and contacts the high-temperature and high-humidity air in the circulation duct. As a result, to effectively reduce moisture from the air, the coolant needs to be continuously supplied to the circulation duct. Thus, as compared to the amount of the moisture removed from the air, an excessive amount of coolant is consumed.

In the prior art, there has been an attempt to solve the aforementioned problem by adjusting the timing for supplying the coolant. For example, a method to control the timing for jetting the coolant using a temperature sensor has been proposed. In this method, the temperature sensor has to be installed somewhere in the circulation duct to detect the temperature of the coolant or the air passing through the circulation duct. In this method, the coolant is jetted at a time when the detected temperature reaches a certain temperature.

However, to use such a control method, the temperature sensor needs to be in the circulation duct. As a result, manufacturing cost increases, and the assembly of the circulation duct becomes complicated. Furthermore, if failure in the temperature sensor occurs, the time for jetting the coolant cannot be adjusted.

A conventional drum type washing machine may be disclosed in Korean Patent Application Publication No. 10-2007-0064017.

SUMMARY

The present disclosure has been made in an effort to provide a method for a drum type washing machine, capable of effectively drying laundry with a small amount of coolant by efficiently adjusting the timing for supplying the coolant.

Exemplary embodiments of the present disclosure provide a method for controlling a drum type washing machine including a condensing duct configured to receive air from a tub, the method comprising supplying a first coolant into a storage unit in the condensing duct holding or maintaining the first coolant in the storage unit; and supplying a second coolant into the storage unit after a preset or predetermined time period elapses, wherein the preset or predetermined time period is shorter by a predetermined time length than an expected time period for thermal equilibrium between the coolant in the storage unit and the air in the condensing duct (e.g., after the first coolant is supplied.

In some embodiments, the expected time period for thermal equilibrium may be calculated based on the temperature of the air in the condensing duct, the temperature of the coolant in the storage unit, the flow rate of the air in the condensing duct, the flow rate of the coolant supplied into the storage unit, the length of time during which supplying the first coolant occurs, and the specific heat of the coolant.

In other embodiments, the method may further comprise holding or maintaining the second coolant in the storage unit; and supplying further coolant into the storage unit after holding or maintaining the second coolant. The second coolant or the further coolant may replace at least a portion of the coolant previously held or maintained in the storage unit.

In various embodiments, supplying the second coolant and/or resupplying the coolant may occur for a time period shorter than a time period during which the first coolant is supplied.

In one or more embodiments, the condensing duct may comprise an inner tube through which the air flows, and an outer tube surrounding at least a section of the inner tube. The storage unit may be or comprise a space between the inner tube and the outer tube.

In some embodiments, the first coolant may be supplied until the storage unit fills with the coolant.

In various embodiments, at least a portion of the first coolant may overflow into the inner tube from the storage unit when the second coolant is supplied to the storage unit.

In one or more embodiments, the method may further comprise supplying the second coolant before turning off a fan in a heating duct connected to one end of the condensing duct.

In some embodiments, the method may further comprise turning off the heater while the fan is turned off.

Other exemplary embodiments of the present disclosure provide a method for controlling a drum type washing machine including a condensing duct configured to receive air from a tub during a drying operation, the method comprising setting a first time period at before the drying operation; supplying a first coolant to a storage unit of the condensing duct for a preset time period at a beginning of the drying operation; holding the first coolant; and supplying a second coolant to the storage unit after a second time period, wherein the first time period is a time expected before the first coolant comes into thermal equilibrium with the air in the condensing duct, and the second time period is shorter than the first time period by a predetermined time length.

In various embodiments, the method may further comprise setting a third time period before the drying operation; holding the second coolant in the storage unit; and resupplying the second coolant to the storage unit after a fourth time period, wherein the second supply the coolant occurs for a second preset time period, the second coolant replaces a portion of the first, the third time period is a time period expected before the second coolant comes into thermal equilibrium with the air in the condensing duct, and the fourth time period is a time period shorter than the third time period by a second predetermined time length. The second present time period may be same as or different from the first preset time period. In addition, the second predetermined time length may be the same as or different from the first predetermined time length.

Other exemplary embodiments of the present disclosure provide a method for controlling a drum type washing machine including a condensing duct with a partition wall that separates an air passage along which air from a tub flows, the method comprising: supplying coolant to a storage unit in the condensing duct; drying laundry for an initial preset time period during which a temperature of the coolant in the storage unit increases, in which moisture in the air passage is condensed by heat transfer between the coolant and the air; and replacing at least a portion of the coolant in the storage unit with new coolant.

In various embodiments, the new coolant may have a smaller volume than the coolant supplied in the initial supplying process.

In one or more embodiments, the drying process and the replacing process may alternate and/or be repeated, and a preset time period for a drying process performed after a replacing process may be equal to or shorter than the initial preset time period.

According to examplary embodiments, by efficiently adjusting the timing for supplying and/or replacing the coolant, it is possible to improve drying efficiency and/or achieve a drying effect using a relatively small amount of coolant.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 9 is a flowchart describing a method for controlling a drum type washing machine according to still other exemplary embodiments of the present disclosure.

DETAILED DESCRIPTION

Figure 1:
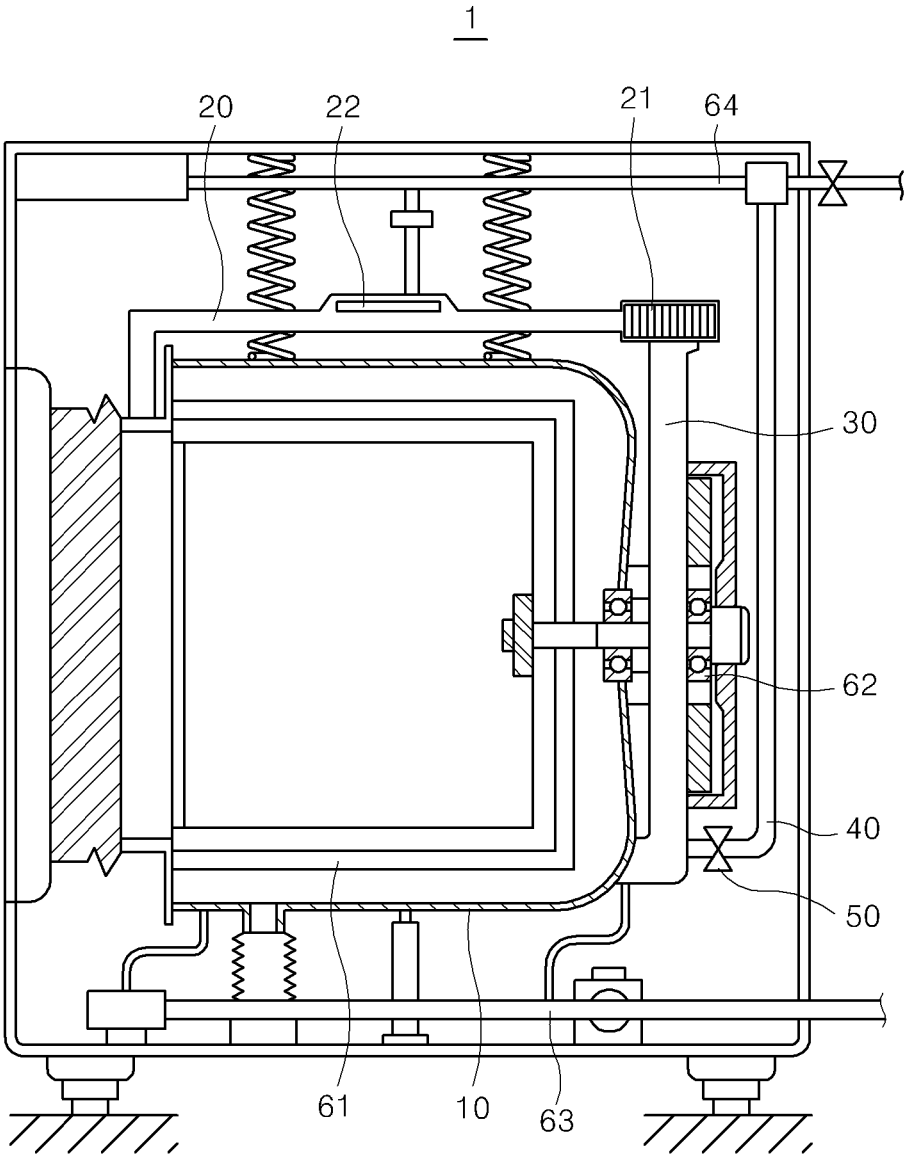
FIG. 1 is a cross sectional view schematically illustrating an exemplary drum type washing machine in accordance with exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, exemplary embodiments according to the present disclosure will be described in detail with reference to the accompanying drawings. Various configurations of the present disclosure, and operations and/or effects according to the configurations of the present disclosure, will be clearly understood by the detailed description below.

It should be noted that the drawings are schematically provided and not necessarily to scale. The relative dimensions and ratios of the parts illustrated in the drawings may be exaggerated or reduced in size for clarity and convenience in the drawings, and the dimensions are only examples without limitation. In the following description, the same elements will be designated by the same reference numerals although the elements are illustrated in different drawings, and a detailed explanation of known related constitutions may be omitted so as to avoid unnecessarily obscuring the subject matter of the present disclosure.

Exemplary embodiments of the present disclosure show ideal examples of the present disclosure. Accordingly, the exemplary embodiments shown in the drawings are expected to be changed in various ways. Therefore, the exemplary embodiments are not limited to specific configurations in the drawings, and may be changed to have various shapes and/or arrangements (e.g., by manufacturing).

Figure 2:
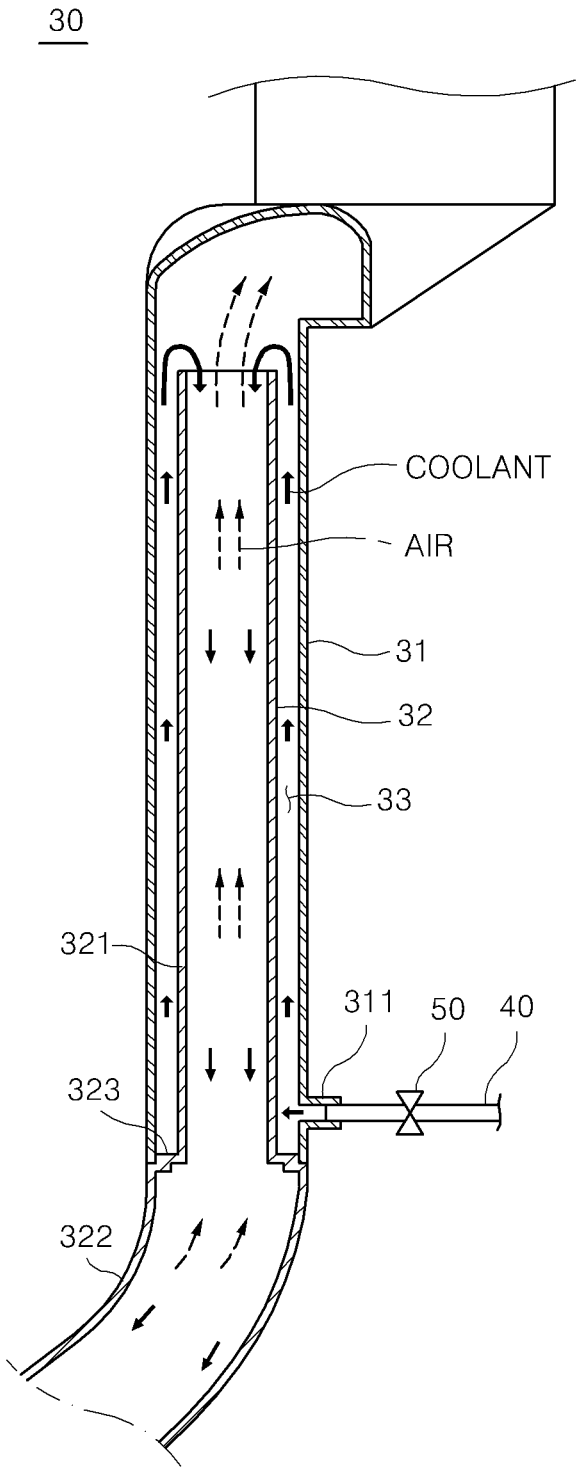
FIG. 2 is an enlarged cross sectional view of the exemplary condensing duct of FIG. 1.

Hereinafter, a drum type washing machine 1 in accordance with exemplary embodiments of the present disclosure will be described with reference to FIG. 1 to FIG. 3. FIG. 1 is a cross sectional view schematically illustrating the drum type washing machine 1 in accordance with the exemplary embodiments of the present disclosure. FIG. 2 is an enlarged cross sectional view of the exemplary condensing duct 30 of FIG. 1, and FIG. 3 is an exploded perspective view of the exemplary condensing duct 30 of FIG. 1.

Figure 3:
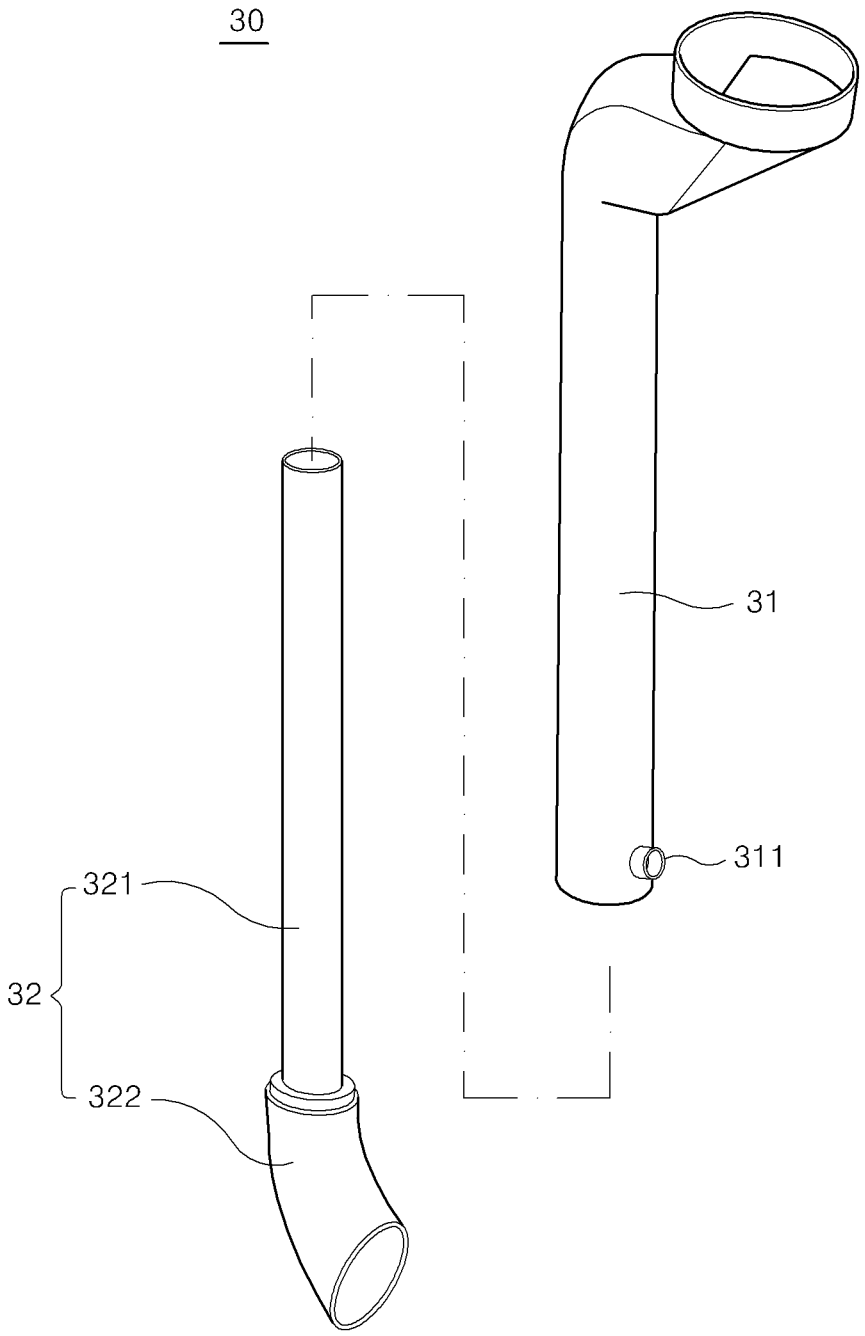
FIG. 3 is an exploded perspective view of the exemplary condensing duct of FIG. 1.

Referring to FIG. 1 to FIG. 3, the drum type washing machine 1 in accordance with the exemplary embodiments of the present disclosure may include a tub 10, a heating duct 20, a condensing duct 30 and a coolant supplying unit 40. The tub 10 accommodates water, and the heating duct 20 may be outside the tub 10. One end of the condensing duct 30 may be connected to the tub 10, and the other end of the condensing duct 30 may be connected to the heating duct 20. The coolant supplying unit 40 may be configured to supply coolant to the condensing duct 30. The heating duct 20 and the condensing duct 30 may form a flow path through which the air in the tub 10 is circulated. Furthermore, the drum type washing machine 1 may further include a drum 61, a driving device 62 and a drain 63. The drum 61 may be rotatably in the tub 10 and configured to hold the laundry. The driving device 62 may be mounted on, under or behind the tub 10 and rotate the drum 61. The drain 63 may be configured to drain the wash water from the tub 10 after the washing of the laundry is completed. The heating duct 20 may be equipped with a fan 21 and a heater 22. Furthermore, a water supply device 64 that supplies the wash water to the drum 61 may be above the drum 61.

When drying operation begins, the air in the tub 10 may be circulated via the condensing duct 30 and the heating duct 20. Here, with the fan 21 operating, the air in the tub 10 may be discharged to the condensing duct 30. In the condensing duct 30, moisture in the air discharged from the tub 10 may be reduced by the air being condensed. After passing the heating duct 10, the air from which the moisture is removed by the condensing duct 30 may flow back to the tub 10. While passing the heating duct 10, the air with reduced moisture may be heated by the heater 22 after passing the fan 21, and return back to the tub 10 as high-temperature dry air.

The heating duct 20 may be horizontally disposed above the tub 10, and the condensing duct 30 may extend in a vertical direction at the rear of the tub 10. In such a configuration, the fan 21 may be adjacent to a joint of the heating duct 20 and the condensing duct 30, and the heater 22 may be in the heating duct 20. A lower end of the condensing duct 30 may be connected to a lower portion of the tub 10, and an upper end of the condensing duct 30 may be connected to the heating duct 20.

The coolant supplying unit 40 is configured to supply coolant to the condensing duct 30. The condensation of the moisture in the air flowing in the condensing duct 30 may be enhanced by the coolant. In exemplary embodiments, the coolant supplying unit 40 may be or comprise a pipe from the water supply device 64. However, this configuration is an example, and the invention is not limited thereto. By way of non-limiting example, the coolant supplying unit 40 may be separate from the water supply device 64, and may include a driving unit or pump for supplying the coolant. Furthermore, a coolant valve 50 for controlling the supply and/or flow rate of the coolant may be at the coolant supplying unit 40 or along the pipe from the water supply device 64.

Meanwhile, the condensing duct 30 may include an outer tube 31 and an inner tube (or air tube) 32. The air from the tub 10 may pass through the inner tube 32, and at least a part of the inner tube 32 may be in the outer tube 31. The entire inner tube 32 may be in the outer tube 31, or only a part of the inner tube 32 may be in the outer tube 31. An outer surface of the portion of the inner tube 32 may be spaced apart or separated from an inner surface of the outer tube 31, so that a clearance or storage space 33 is formed between the outer tube 31 and the inner tube 32.

The clearance or storage space 33 may be sealed at the bottom, and the coolant may fill the clearance or storage space 33 when supplied thereto. The clearance or storage space 33 may store the coolant within the condensing duct 30. For example, as shown in FIG. 2, the outer tube 31 and the inner tube 32 may be firmly engaged with or connected to each other, such that the bottom of the clearance or storage space 33 is tightly sealed.

To elaborate, the outer tube 31 may be a tube having a predetermined inner diameter and a predetermined outer diameter. Meanwhile, the inner tube 32 may include an insert 321 having an outer diameter smaller than the inner diameter of the outer tube 31; and a connector 322 having an outer diameter larger than the inner diameter of the outer tube 31. The connector 322 is below the insert 321 and may extend downward from a lower end of the insert 321. As depicted in FIG. 2 and FIG. 3, the outer tube 31 and the inner tube 32 may engage or connect to each other such that the insert 321 is in the outer tube 31, and a lower end of the outer tube 31 is in contact with an upper end of the connector 322 at the same time. Since the outer diameter of the insert 321 is smaller than the inner diameter of the outer tube 31, the clearance or storage space 33 may be between the outer surface of the inner tube 32 and the inner surface of the outer tube 31. Meanwhile, since the outer diameter of the connector 322 is larger than the inner diameter of the outer tube 31, the connector 322 is located under the lower end of the outer tube 31 rather than being in the outer tube 31. As the upper end of the connector 322 and the lower end of the outer tube 31 firmly contact each other, the bottom of the clearance or storage space 33 may be sealed.

The inner tube 32 may be forcibly inserted in the outer tube 31. Further, a stepped section, ring or protrusion 323 may be at the joint of the insert 321 and the connector 322. The stepped section, ring or protrusion 323 may have an outer diameter that allows the stepped section, ring or protrusion 323 to make an interference fit (e.g., a press fit or friction fit) with the outer tube 31. As the stepped section, ring or protrusion 323 is forcibly fitted in the outer tube 31, the inner tube 32 and the outer tube 31 may be engaged or connected with each other.

The connector 322 may be connected to the drain 63 to allow condensed water produced during the condensation of the air, or overflowing coolant, which is described later, to be discharged from the washing machine 1.

The coolant supplying unit 40 may be configured to supply the coolant to the clearance or storage space 33. To elaborate, a coolant inlet 311 may be at a lower most portion of the outer tube 31 of the condensing duct 30, and the coolant inlet 311 may be connected to the coolant supplying unit 40. The coolant valve 50 at or in the coolant supplying unit 40 controls a flow rate of the coolant supplied to the coolant inlet 311, thus adjusting the amount of coolant filling the clearance or storage space 33.

An upper end of the inner tube 32 may be open and is positioned below an upper end of the outer tube 31. When the bottom of the clearance or storage space 33 is sealed, the top of the clearance or storage space 33 may be open. In such a configuration, when the coolant is continuously supplied to the clearance or storage space 33, the coolant may fill up the entire clearance or storage space 33, and then may flow over the open top of the clearance or storage space 33. The overflowing coolant may enter the inner tube 32 via the open upper end of the inner tube 32. After reaching the inner tube 32, the coolant may flow along the inner surface of the inner tube 32 and drain in the lower portion thereof by the drain 63.

As stated above, when the coolant enters in the clearance or storage space 33, the coolant may first come into contact with the outer surface of the inner tube 32. As a result, a preliminary heat exchange may occur between the coolant and the air flowing in the inner tube 32. Thereafter, when the coolant overflows into the inner tube 32 and comes into direct contact with the air flowing through the inner tube, a secondary heat exchange may occur between the coolant and the air. Accordingly, the moisture in the air may be reduced effectively even with a smaller amount of coolant.

When the coolant is supplied to the clearance or storage space 33, the condensed water drops produced during the condensation of the air may cling to the inner surface of the inner tube 32. These condensed water drops may be effectively removed from the inner surface of the inner tube 32 by the coolant being introduced into the inner tube 32 and flowing down along the inner surface of the inner tube 32.

The coolant supplying unit 40 may be connected to a lower side or end of the outer tube 31. In such a configuration, the coolant may fill the clearance or storage space 33, staring from a bottom portion of the clearance or storage space 33. Since the bottom of the clearance or storage space 33 is tightly sealed, the coolant may fill the clearance or storage space 33 from the bottom of the clearance or storage space 33. As the coolant is supplied from the bottom of the clearance or storage space 33, the coolant may be prevented from reaching the heating duct 20 even with the fan 21 operating.

Below, an operation and an effect of the drum type washing machine 1 having the above-described configuration in accordance with the exemplary embodiments will be explained.

Figure 4:
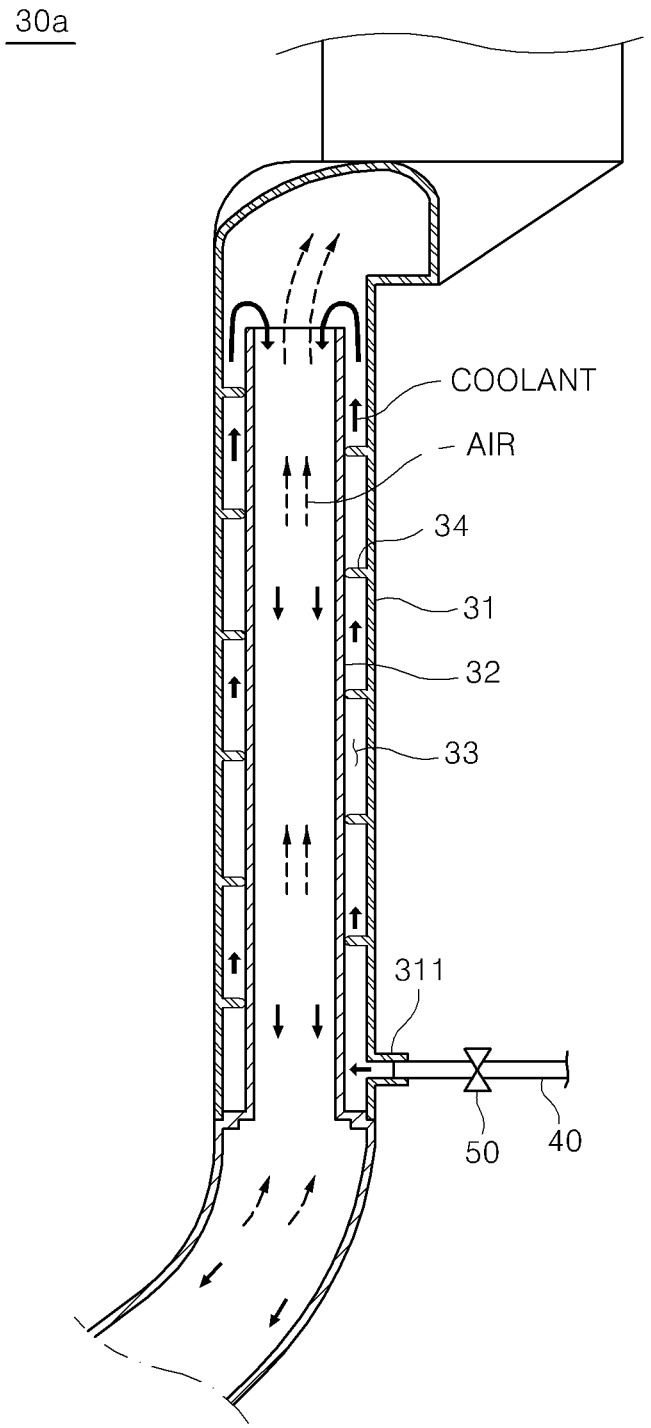
FIG. 4 is an enlarged cross sectional view of an exemplary condensing duct for a drum type washing machine in accordance with other exemplary embodiments of the present disclosure.

If the fan 21 operates, the air in the tub 10 may move into the condensing duct 30. The condensing duct 30 has a double-tube structure, and within the condensing duct 30, the clearance or storage space 33 is filled with the coolant supplied from the coolant supplying unit, as stated above. The air from the tub 10 may be moved to the heating duct 20 through the inner tube 32 that forms the inner sidewall of the clearance or storage space 33. In FIG. 2 and FIG. 4, dashed-line arrows indicate a flow of air within the condensing duct 30, and solid-line arrows indicate a flow of the coolant through the clearance or storage space 33.

When the coolant passes through the clearance or storage space 33, there may be an exchange of heat between the coolant and the air passing through the inner tube 32, and the temperature of the air may decrease. Accordingly, a dew point may also decrease, and moisture in the air can be condensed.

The air may come into indirect contact with the coolant and the sidewall of the clearance or storage surface 33. The indirect contact may be made throughout the entire side surface area of the inner tube 32. Since the coolant stays and is stored in the condensing duct 30 as it fills the clearance or storage space 33, the coolant filling the clearance or storage space 33 is capable of absorbing heat from the air passing through the inner tube 32 continuously until the coolant and the air reach thermal equilibrium. Thus, efficient heat exchange may be performed between the coolant and the air, so that the moisture in the air can be effectively reduced only with a small amount of coolant.

Furthermore, before the coolant and the air passing through the inner tube 32 reaches the thermal equilibrium, by way of example, when the temperature of the coolant becomes close to the thermal equilibrium, or when a certain time has elapsed after the coolant is supplied, the coolant supplying unit 40 may replenish the clearance or storage space 33 with new coolant. Accordingly, a reduction of condensing efficiency may be prevented.

If the coolant is additionally supplied from the coolant supplying unit 40, the coolant previously supplied in the clearance or storage space 33 may overflow to the inner tube 32 through the top opening of the clearance or storage space 33. This overflowed coolant may flow downwardly, while effectively removing condensed water drops clinging to the inner surface of the inner tube 32 and absorbing the moisture in the air. Then, the coolant may be discharged through the drain 63. A condensing duct 30*a* included in a drum type washing machine in accordance with other exemplary embodiments of the present disclosure will be discussed with reference to FIG. 4 and FIG. 5. This exemplary embodiment is different from the above-described exemplary embodiment by the feature in which a fluid guiding member 34 is further included in the condensing duct 30*a*. Other configurations are substantially the same as those of the aforementioned exemplary embodiment(s) with regards to FIG. 3. Thus, like parts will be assigned like reference numerals and redundant description(s) thereof will be omitted. Below, only distinctive parts will be elaborated.

Figure 5:
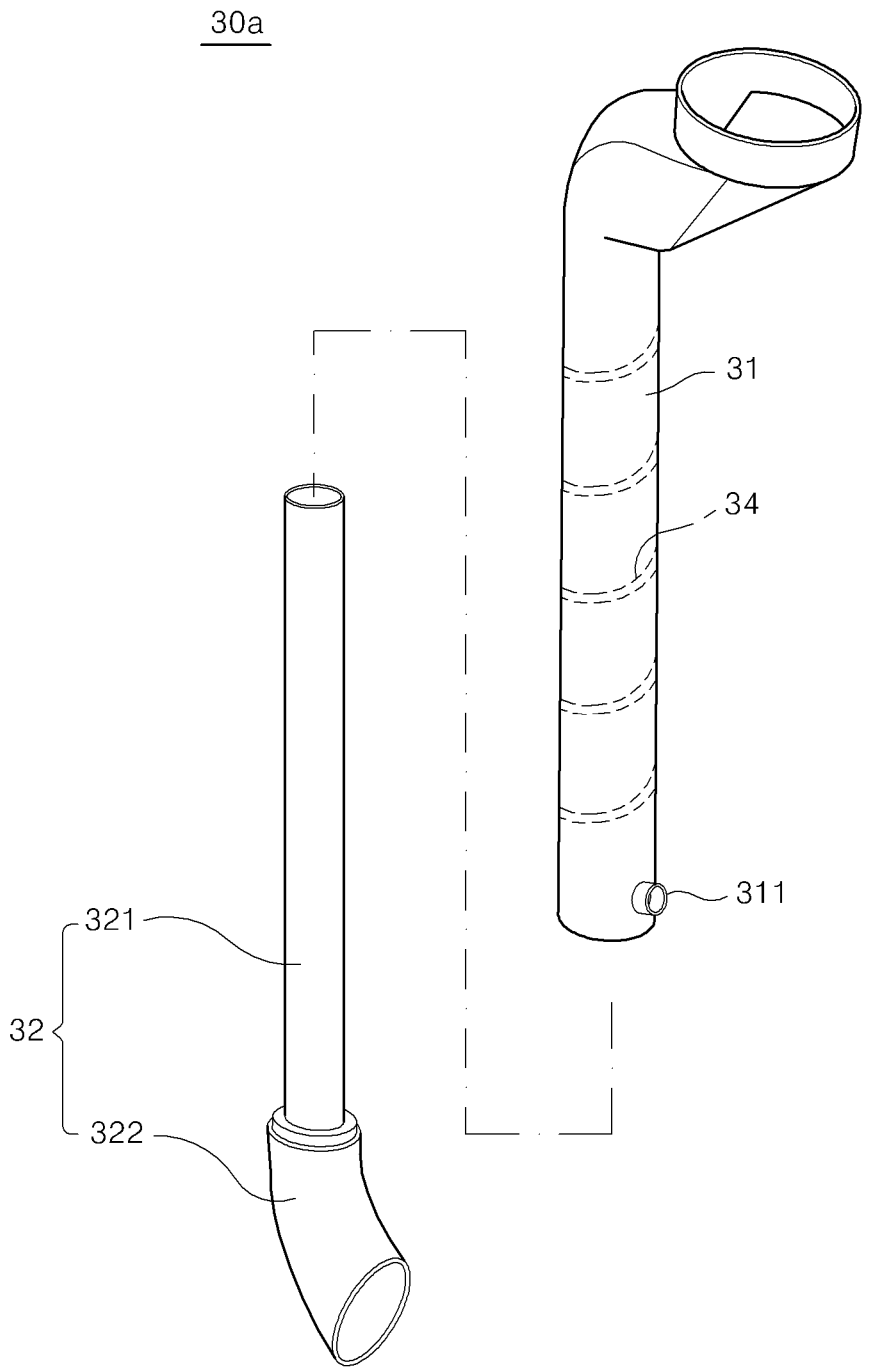
FIG. 5 is an enlarged perspective view of the exemplary condensing duct of FIG. 4.

FIG. 4 is an enlarged cross sectional view of an exemplary condensing duct 30*a* applied to the drum type washing machine in accordance with other exemplary embodiments. FIG. 5 is an exploded perspective view of the condensing duct 30*a* of FIG. 4.

As depicted in FIG. 4 and FIG. 5, the condensing duct 30*a* of the drum type washing machine in accordance with exemplary embodiments may further include a fluid guiding member 34 in the clearance or storage space 33 between the outer tube 31 and the inner tube 32. The fluid guiding member 34 may be in the clearance or storage space 33 along a longitudinal direction of the condensing duct 30*a* to form one or more coolant fluid paths within the clearance or storage space 33. The fluid guiding member 34 may form a single long path in the clearance or storage space 33, or form multiple paths in the clearance or storage space 33 by partitioning the clearance or storage space 33 into plural components or sections. In the case of forming a single long path, the long path formed by the fluid guiding member 34 may be extended spirally in the longitudinal direction of the condensing duct 30*a*.

In exemplary embodiments, the fluid guiding member 34 is or comprises, by way of non-limiting example, a protrusion having a preset height that protrudes from an inner surface of the outer tube 31. The protrusion may extend spirally in the longitudinal direction of the outer tube 31. The protrusion may extend in a manner causing the coolant to flow in a counter-clockwise direction, as shown in FIG. 4, or in a clockwise direction. In one embodiment, the lower-most part of the fluid guiding member 34 is just above and behind the location of the inlet 31.

Furthermore, the height of the protrusion may be equal to or smaller than a gap between the outer surface of the inner tube 32 and the inner surface of the outer tube, and an end or outer tip of this protrusion may be in contact with the outer surface of the inner tube 32. By the presence of such a protrusion, a spiral fluid path may be formed. In FIG. 4 and FIG. 5, this exemplary embodiment is illustrated.

As another example of the fluid guiding member 34, the fluid guiding member may be a protrusion having a preset height that protrudes from the outer surface of the inner tube 32. The protrusion may extend spirally in the longitudinal direction of the inner tube 32. As in the above example, the height of this protrusion may be equal to or smaller than the gap between the outer surface of the inner tube 32 and the inner surface of the outer tube 31, and an end or outer tip of this protrusion may be in contact with the inner surface of the outer tube 31. By the presence of such a protrusion, a spiral flow path may be formed.

If the fluid path is formed in the clearance or storage space 33 by the fluid guiding member 34, the coolant supplied to the clearance or storage space 33 may flow along the fluid path. Especially when a spiral fluid path is formed in the condensing duct 30, the coolant may flow spirally up the inner tube 32. Accordingly, the fluid path through which the coolant flows in the clearance or storage space 33 may be lengthened, so that a time period during which the air and the coolant are in indirect contact with each other can be lengthened. As a consequence, the moisture in the air can be more effectively reduced even with a small amount of coolant.

Furthermore, the fluid guiding member 34 may also prevent the occurrence of convection of the coolant within the clearance or storage space 33. Accordingly, the coolant having a temperature that has increased due to the heat transferred from the air can be prevented from mixing with new low-temperature coolant. Accordingly, the new coolant can effectively maintain its low temperature. Particularly, when the inlet through which the new low-temperature coolant is introduced is at an initial contact point between the condenser and the air, the newly introduced coolant may come into contact with the air before experiencing a temperature rise by heat exchange. As a result, the air with the highest temperature indirectly contacts the newly introduced coolant with the lowest temperature, and thus, the temperature of the air can be lowered more effectively.

Furthermore, as set forth above, the fluid guiding member 34 may protrude from the outer tube 31 and be in contact with the inner tube 32, or may protrude from the inner tube 32 and be in contact with the outer tube 32. With this configuration, the fluid guiding member 34 is capable of connecting the outer tube 31 and the inner tube 32 across the clearance or storage space 33, and thus is capable of supporting the inner tube 32 effectively within the outer tube 31. Thus, the double-tube structure of the condensing duct 30*a* may be stronger.

Below, a drum type washing machine method according to exemplary embodiments of the present disclosure will be explained with reference to FIG. 6 to FIG. 9.

Figure 6:
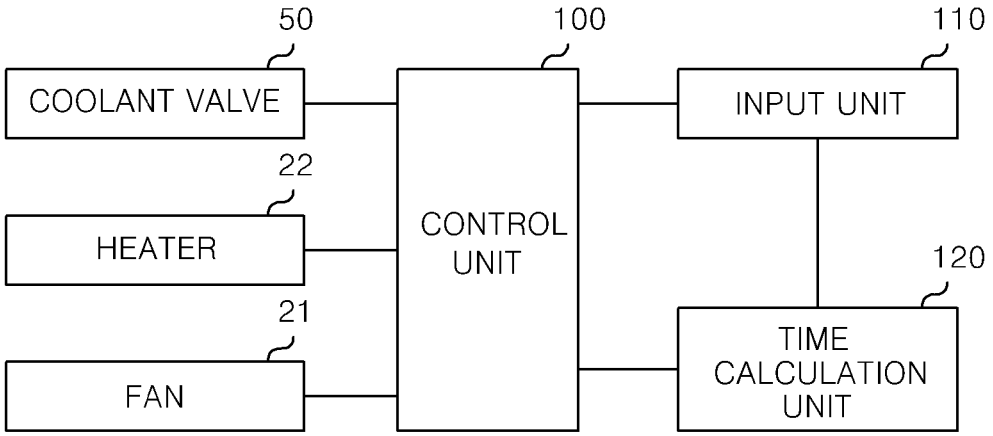
FIG. 6 is a block diagram illustrating an exemplary control device configured to control the exemplary drum type washing machine according to exemplary embodiments of the present disclosure.

FIG. 6 is a block diagram showing an exemplary control device for performing the exemplary method of controlling a drum type washing machine according to the exemplary embodiments.

Referring to FIG. 6, the control device of exemplary embodiments may include a control unit 100, an input unit 110, and a time calculation unit 120. The control unit 100 is configured to control the coolant valve 50, the fan 21 and the heater 22.

The input unit 110 may be configured to receive an input (e.g., one or more washing operation selections and/or setting values) from a user and send the received input to at least one of the control unit 100 and the time calculation unit 120. The input unit 110 may receive from the user an input of at least one of a time period value, a flow rate of air in the condensing duct 30, a flow rate of coolant supplied to the condensing duct 30, a temperature of the air flowing in the condensing duct 30, and a temperature of the coolant. The time period value is a basis for determining the timing for supplying the coolant. The time period value may include at least one or two of a first time period to a fourth time period, a preset time period A and a preset time period B that are described later.

The time calculation unit 129 may be configured to calculate at least one of the aforementioned time period values based on a value previously set in the control unit 100, or based on the input value received from the input unit 110. The time period value may be received from the user through the input unit 110, or may be calculated by the time calculation unit 120. The time period value calculated in the time calculation unit 120 may be sent to the control unit 100.

As one example, the time calculation unit 120 may calculate a time period expected before the coolant in the clearance or storage space 33 comes into thermal equilibrium with the air flowing in the condensing duct 30 as a first time period or a third time period. The first time period and the third time period may be calculated based on at least one of the temperatures of the air in the condensing duct 30 and the coolant in the clearance or storage space 33, the flow rate of the air in the condensing duct 30, a flow rate of the coolant supplied to the condensing duct 30, a length of time during which the coolant is supplied, and a specific heat of the coolant (which is known for a particular coolant, such as water). Furthermore, the time calculation unit 120 may be also capable of calculating a second time period and a fourth time period by subtracting a predetermined time length from the first time period and the third time period, respectively.

The control unit 100 may be configured to control the operations of the coolant valve 50, the fan 21 and the heater 22 based on the value(s) previously set in the control unit 100, the input value(s) received from at least one of the input unit 100 and the time calculation unit 120, and/or the aforementioned calculated time period values. The control unit 100 may change an open or closed state of the coolant valve 50. When the coolant valve 50 is open, the coolant is introduced into the condensing duct 30, whereas when the coolant valve 50 is closed, the coolant is stopped. Furthermore, the control unit 100 may change a power-on and power-off state of the fan 21 and the heater 22. When powered on, the fan 21 and the heater 22 operate, whereas when powered off, the operations of the fan 21 and the heater 22 are stopped.

Figure 7:
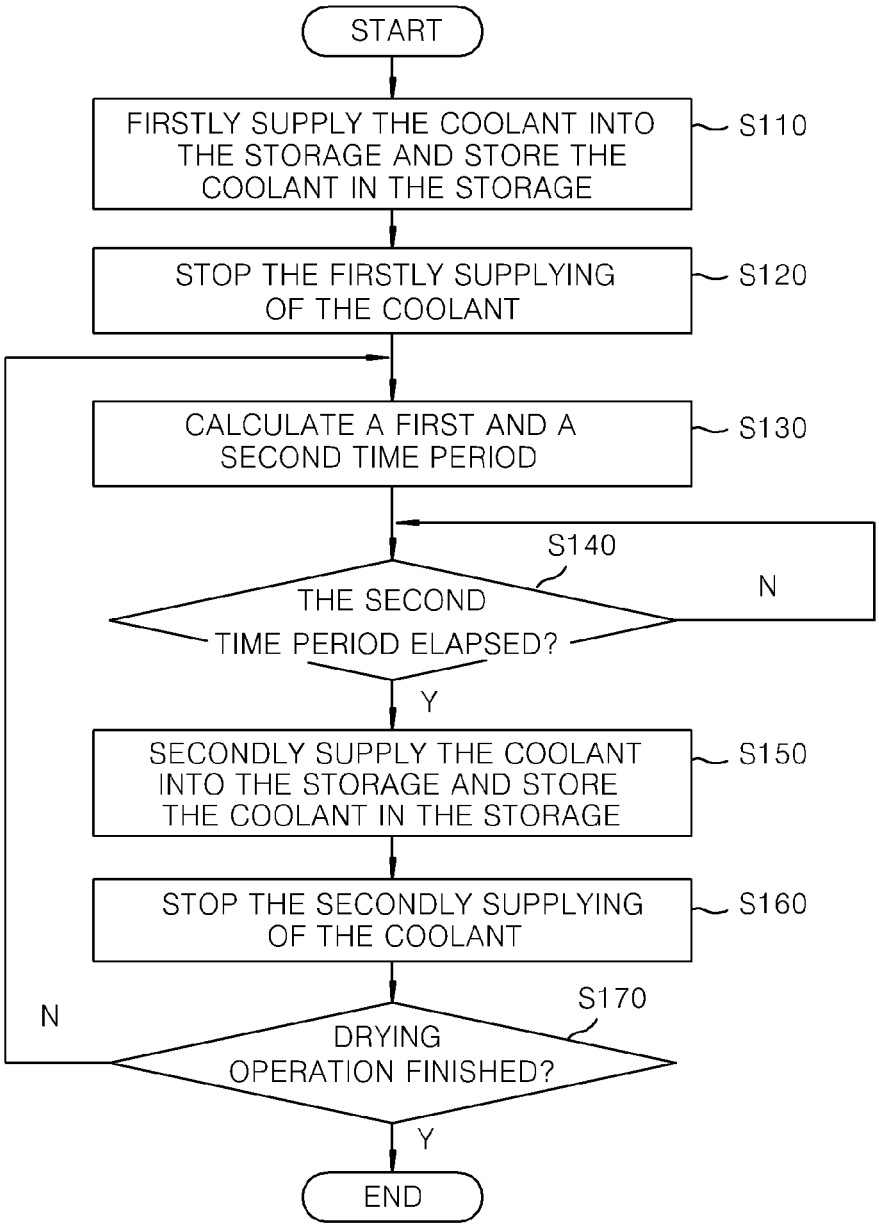
FIG. 7 is a flowchart describing a method for controlling a drum type washing machine according to exemplary embodiments of the present disclosure.

FIG. 7 is a flowchart for describing an operation of the control unit 100 and/or an exemplary method for controlling a drum type washing machine according to exemplary embodiments. Below, exemplary embodiments will be elaborated with reference to FIG. 7.

First, the control unit 100 may open the coolant valve 50, thus allowing the first coolant to be supplied into a storage unit for the coolant within the condensing duct 30, and the coolant supplied to the storage unit may be stored therein (S110). Here, the coolant may be supplied to the clearance or storage space 33 between the inner tube 32 and the outer tube 31. The clearance or storage space 33 of the condensing duct 30 may be used as the storage unit for the coolant. Thus, the inner tube 32 may serve as an air passage along which air from the tub 10 flows, and a sidewall of the inner tube 32 may serve as a partition and/or wall that separates the air passage and the storage unit for the coolant. The coolant supplied into the storage unit may be stored therein, while contacting the surface of the air passage (i.e., contacting the partition and/or wall). The control unit 100 may control the coolant valve 50 to allow the coolant to be supplied to the clearance or storage space 33 until the clearance or storage space 33, the storage unit, is filled with the coolant.

Then, the control unit 100 may stop supplying the first coolant by closing the coolant value 50 (S120).

The control unit 100 may control the time calculation unit 120 to calculate the first time period, and control the time calculation unit 120 to calculate the second time period (or set time period) based on the calculated first time period (S130). The first and second time periods are generally calculated before any drying operation is initiated or begun, and typically before the coolant is supplied to the storage unit.

As described above, the first time period is a time period expected for the first coolant in the coolant storage unit come into thermal equilibrium with the air in the condensing duct 30, after supply of the first coolant is stopped. If the first time period begins when the supply of the first coolant stops. When the first time period elapses, it is expected that the coolant in the coolant storage unit and the air flowing in the condensing duct 30 are in thermal equilibrium. Thus, the temperature of the coolant may not increase any more, and the temperature of the air may not decrease at all. As mentioned above, the coolant storage unit may be the clearance or storage space 33.

The first time period may be calculated based on at least one of the temperature of the air, the temperature of the coolant, the flow rate of the air flowing in the condensing duct 30, the flow rate of the coolant supplied to the storage unit, the length of time during which the coolant is supplied, and the specific heat of the coolant. These values may be previously set in the control unit 100, inputted through the input unit 110, or detected by another device. By way of example, the flow rates of the air and the coolant may be constant, and a length of time during which the first or second supply of the coolant occurs may be measured.

The second time period (or set time period) may be shorter than the first time period by a predetermined time length. The predetermined time length may be constant, and may be based on margins of error in the measurements and/or determinations of known values used in the calculation of the first time period.

Once the second time period is determined (e.g., calculated), the control unit 100 may determine whether the second time period (or set time period) has elapsed since the supply of the first coolant is stopped (S140). If it is determined that the second time period has elapsed, the control unit 100 may open the coolant valve 50 back, thus allowing the second coolant to be supplied to the storage unit (S150). The supply of the second coolant may occur for the same time period as the supply of the first coolant, or may occur for a time period shorter than the time period during which the first coolant is supplied. Meanwhile, if it is determined that the second time period has not elapsed, the control unit 100 may wait for a certain time and then determine again whether the second time period has elapsed.

When the supply of the second coolant occurs, the second coolant may be stored into the storage unit, replacing at least a portion of the previously stored coolant (i.e., a portion of the first coolant). For example, assume that the clearance or storage space 33 fills with the first coolant. In such a case, if coolant with the same volume as the first supplied coolant is supplied to the storage unit in the second supply of the coolant, the second supplied coolant may fill the clearance or storage space 33, replacing the entire first supplied coolant. The first supplied coolant may already have undergone a temperature rise as a result of heat exchange with the air. Since the new coolant has a low temperature, the coolant within the clearance or storage space 33 can be completely replaced by the low-temperature coolant. Meanwhile, if the volume of the second supplied coolant is smaller than that of the first supplied coolant, only a portion of the previously stored coolant may be replaced by the new coolant. In such a case, the temperature of the coolant in the clearance or storage space 33 may be lowered as the new low-temperature coolant mixes with the previously stored high-temperature coolant.

As a result of the second supply of coolant into the coolant storage unit, at least a portion of the first coolant may overflow the top of the clearance or storage space and flow into the inner tube 32. By way of example, when the clearance or storage space 33 fills with the coolant after the first supply of coolant, the coolant may be forced to move upward when the second supply of coolant occurs and may overflow the open end of the inner tube 32 and enter into the inner tube 32. Then the coolant may flow down along the inner wall of the inner tube 32, eliminating droplets clinging thereon.

Thereafter, the control unit 100 may the coolant valve 50 again, thus stopping the second supply of coolant (S160). The control unit 10 may then determine whether the drying process has completed (S170). If the drying process has not yet completed, the control unit 100 may control the time calculation unit 120 to calculate the first time period and the second time period again. If the drying process has completed, the control unit 100 may terminate the supply of the coolant.

When calculating the first time period again, the time calculation unit 120 may calculate, as a new first time period, a time period expected for the coolant in the clearance or storage space 33 to come into thermal equilibrium with the air in the condensing duct 30, based on the state of the coolant stored in the clearance or storage space 33 after the second supply of the coolant has stopped (S130).

The value of the newly calculated first time period may be equal to or different from the value of the previously calculated first time period before the second supply of the coolant occurs. For example, assume that the clearance or storage space 33 is fills with the coolant by the first supply of the coolant and the second supply of the coolant occurs for the same time period as the time period during which the first supply of the coolant occurs. In such a case, if the flow rate of the coolant being supplied to the clearance or storage space 33 is the same, the newly calculated first time period may be equal to the previously calculated first time period. On the other hand, if the clearance or storage space 33 is fills with the coolant by the first supply of the coolant and the second supply of the coolant occurs for a time period shorter than the time period during which the first supply of the coolant occurs while the flow rate of the coolant being supplied to the clearance or storage space 33 is still set to be the same, the newly calculated first time period (e.g., a "third" time period) may be smaller than the previously calculated first time period.

Based on the newly calculated first time period, a time shorter than the first time period by a predetermined time length may be calculated as a new second time period. The newly calculated second time period (e.g., a "fourth" time period) may be equal to or different from the second time period (or set time period) calculated prior to the second supply of the coolant.

Based on the newly calculated second time period (or set time period), the control unit 100 may determine again whether the newly calculated second time period has elapsed since the second supply of the coolant is stopped (S140). If it is determined that the second time period has elapsed, the control unit 100 may open the coolant valve 50 again, thus allowing the coolant to be supplied to the storage unit again (S150). This process of resupplying the coolant may be the same as or different from the second supply of the coolant. In the latter, resupplying the coolant may occur for a time period longer than or shorter than the time period during which the second supply of the coolant occurs. Upon the completion of the resupply of the coolant, the control unit 10 may stop supplying the coolant (S160) and determine again whether the drying process has completed (S170). The control unit 100 may repeat supplying the coolant and stopping the supply of the coolant until the drying process has completed. FIG. 7 provides a flowchart for an example case where the resupply of the coolant is the same as the second supply of the coolant (S150).

Now, effects of the method for controlling drum type washing machine according to the exemplary embodiments of FIG. 7, including the above-described processes will be discussed.

In the exemplary embodiments of FIG. 7, it is possible to calculate the time expected, after the first supply of the coolant to the clearance or storage space 33, for the air in the condensing duct 30 and the coolant within the clearance or storage space 33 to come into thermal equilibrium, at which point the temperature of the coolant does not increase. If the air and the coolant reach thermal equilibrium, there may be no more heat exchange therebetween, resulting in the effect of condensing the moisture in the air by the coolant to be rapidly reduced. According to exemplary embodiments, however, by supplying new coolant of a low temperature into the clearance or storage space 33 before the calculated time period elapses, the temperature of the previously stored coolant can decrease before the air and the coolant reach thermal equilibrium. Thus, the coolant in the clearance or storage space 33 is continuously allowed to exert the moisture condensing effect.

In addition, by allowing the coolant to stay in the clearance or storage space 33, a high moisture condensing effect can be achieved even with a relatively small amount of coolant. Furthermore, since the coolant is stored in the clearance or storage space 33 right up to the time when the coolant in the clearance or storage space 33 does not exert much, if any moisture condensing effect, a cooling capacity of the coolant within the condensing duct 30 can be maximally utilized.

Furthermore, in exemplary embodiments, it is not required to directly detect the temperature of the air or the coolant. Therefore, no temperature sensor is necessary in the condensing duct 30. As a result, the manufacturing cost of the drum type washing machine can be reduced, and the assembly of the condensing duct 30 can be simplified, and durability of the condensing duct 30 can be improved.

Figure 8:
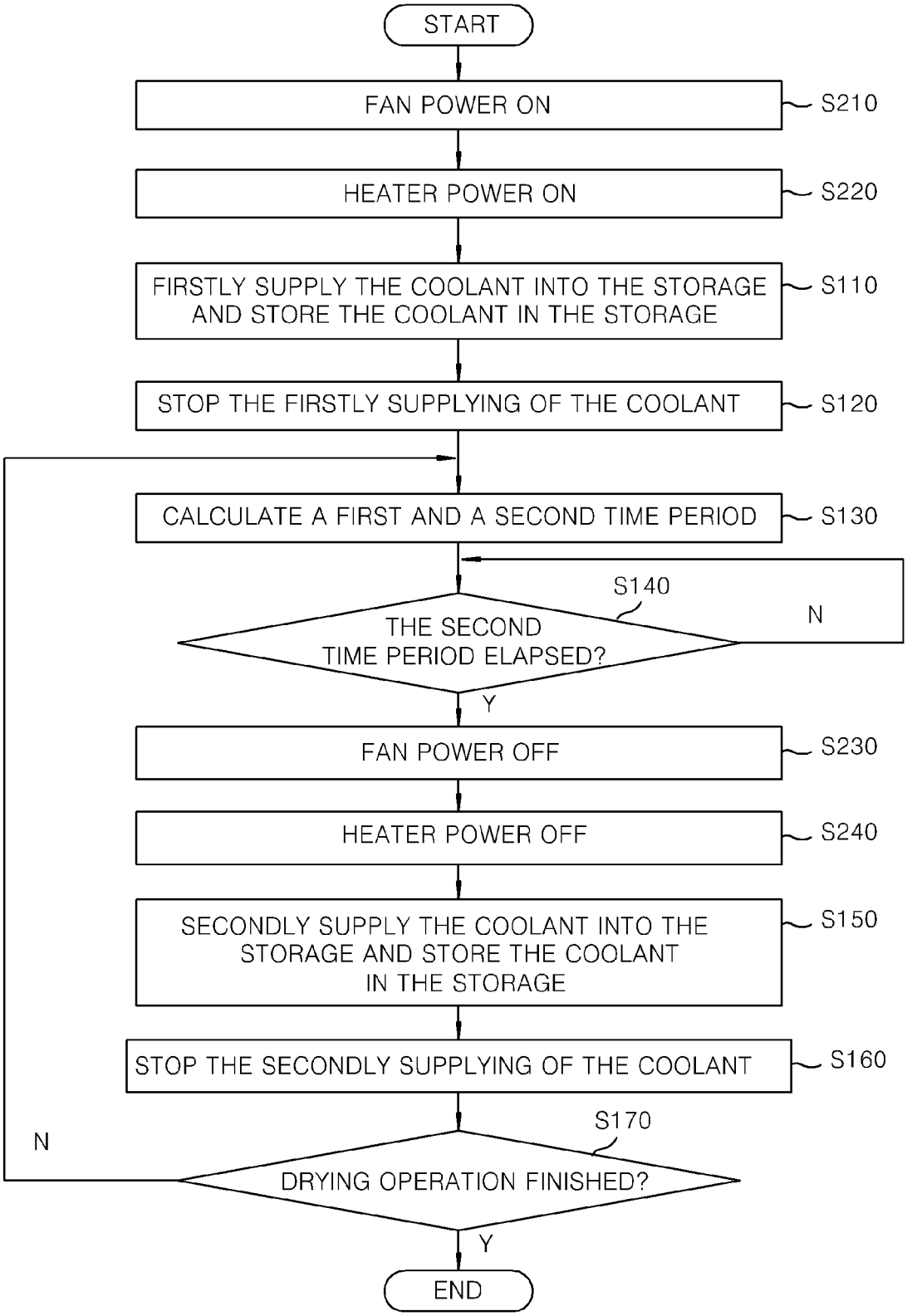
FIG. 8 is a flowchart describing a method for controlling a drum type washing machine according to other exemplary embodiments of the present disclosure.

FIG. 8 is a flowchart for describing an operation of the control unit 100 and/or an exemplary method for controlling a drum type washing machine according to other exemplary embodiments of the present disclosure. Referring to FIG. 8, the present exemplary embodiments will be explained. The exemplary embodiments are different from the exemplary embodiments of FIG. 7 in that the control unit 100 also controls operations of the fan 21 and the heater 22. Description of the other operations will be omitted because they are the same as those of the prior embodiments, and only the distinctive features will be elaborated.

In the present exemplary embodiments, as depicted in FIG. 8, the control unit 100 may first turn on the fan 21 (S210) and then turn on the heater 22 (S220). Turning on the fan 21 and the heater 22 may occur at the beginning of the drying operation.

As in the aforementioned exemplary embodiments of FIG. 7, the control unit 100 may open the coolant valve 50, thus allowing the first coolant to be supplied to the storage unit in the condensing duct 30 (S110). Then, the control unit 100 may close the coolant valve 50, thus stopping the supply of the first coolant (S120). Furthermore, the control unit 100 may control the time calculation unit 120 to calculate the first time period, and then to calculate the second time period (or set time period) based on the first time period (S130). The first and second time periods are generally calculated before any drying operation is initiated or begun, and typically before the coolant is supplied to the storage unit.

Based on the determined (e.g., calculated) second time period, the control unit 100 may determine whether the second time period (or set time period) has elapsed after the supply of the first coolant has stopped (S140). If it is determined that the second time period has elapsed, the control unit 100 may turn off the fan 21 before the supply of the second coolant (S230).

As described before, when the clearance or storage space 33 is fills with the coolant by the first supply of the coolant, the coolant may overflow the top of the clearance or storage space 33 and flow into the inner tube 32 as a result of the second supply of the coolant. At this time, if the fan 21 is operating, the overflowing coolant may be drawn into the fan 21, causing the fan 21 to break down. If the fan 21 is powered off before the second supply of the coolant starts, however, such a problem can be avoided.

Meanwhile, before controlling the coolant valve 50 to start the second supply of the coolant, the control unit 100 may turn off the heater 22 (S240). Here, the control unit 100 may maintain the power-off-state of the heater 22 for a time period during which the fan 21 is powered off.

If the fan 21 is powered off in order to prevent the overflowed coolant from being drawn into the fan 21, a heat dissipation function of the fan 21 is also stopped. If the heater 22 operates in this state, the heating duct 20 may overheat. Thus, by turning off the heater 22 while the fan 21 is turned off, such an overheating problem can be avoided.

Now, a method for controlling a drum type washing machine according to other exemplary embodiments of the present disclosure will be discussed with reference to FIG. 9. The exemplary embodiments are different from the exemplary embodiments described in the flowchart of FIG. 7, in that the first time period and the third time period are previously set in the control unit 100, or inputted through the input unit 110. Here, description of the other operations of the exemplary embodiments will be omitted because they are the same as those of the exemplary embodiments of FIG. 7, and only the distinctive features will be elaborated. FIG. 9 is a flowchart for describing an operation of the control unit 100 and/or the method for controlling a drum type washing machine according to exemplary embodiments.

In the exemplary embodiments, the first time period and the third time period may be set before starting the drying operation (S310). For example, values of the first time period and the third time period may be inputted to the control unit 100 or the time calculation unit 120 by a manufacturer in a manufacturing process of the drum type washing machine 1, according to the present disclosure. Alternatively, the values of the first time period and the third time period may be previously stored in a storage device or unit accessible by the control unit 100, and then loaded and used by the control unit 100 when required. Still alternatively, the values of the first time period and the third time period may be inputted from the user through the input unit 110. The flowchart of FIG. 9 is provided as an example where the values of the first time period and the third time period are inputted by the user through the input unit 110. However, the invention is not limited thereto.

The first time period may be defined in the same way as described before. The third time period is a time period expected for the second supply of coolant in the clearance or storage space 33 to come into thermal equilibrium with the air in the condensing duct 30. If the volume and the temperature of the first coolant in the clearance or storage space 33 are the same as those of the second coolant, the first time period and the third time period may be the same value. Meanwhile, when the volume and/or temperature of the first coolant in the clearance or storage space 33 is/are different from the second coolant, the first time period and the third time period may be different.

The first time period and the third time period may be the values that are previously calculated based on at least one of the temperature of the air in the condensing duct 30, the temperature of the coolant in the storage unit, the flow rate of the air in the condensing duct 30, the specific heat of the coolant, the specific heat of the air and a flow rate of the coolant being supplied to the storage unit. Furthermore, to calculate the first time period and the third time period, the flow rate of the air, the specific heat of the coolant and the flow rate of the coolant may be constant, respectively. Thus, a time period when the supply of the first coolant occurs may be at a first preset time period, and a time period when the supply of the second coolant occurs may be at a preset time period. Here, the first time period and the second time period may be the values inputted from the user through the input unit 110. The first time period may be the same as or different from the second time period.

When the drying operation begins, the control unit 100 may control the coolant valve 50 such that the supply of the first coolant occurs for the first time period, and the first coolant may be stored contacting the surface of the condensing duct 30 (S320). The value of the first time period may be predetermined. For example, if the flow rate of the coolant supplied to the clearance or storage space 33 is constant, the first time period may be a time taken before the clearance or storage space 33 fills with the first coolant. The volume and mass of the coolant supplied first and stored in the clearance or storage space 33 can be calculated based on the value of the first time period.

Thereafter, the control unit 100 may control the coolant valve 50 to stop the first supply of the coolant (S330). Then, the control unit 100 may determine whether the second time period has elapsed since the first supply of the coolant is stopped (S340). As stated earlier, the second time period may be a time period shorter than the first time period by a predetermined time length. If the second time period has not yet elapsed, the control unit 100 may wait for a certain time and determine again whether the second time period has elapsed.

If the second time period has elapsed, the control unit 100 may control the coolant valve 50 to start the supply of the second coolant for the second time period (S350). The supply of the second coolant may replace a portion or the entire amount of the first coolant, and may be stored contacting the surface of the condensing duct 30. The value of the second time period may also be predetermined. When the first time period is before the clearance or storage space 33 fills with the first coolant and the second time period is equal to the first time period, the second coolant may replace the previously stored first coolant. Alternatively, if the second time period is shorter than the first time period, the second coolant may replace only a portion of the previously stored first coolant.

Subsequently, the control unit 100 may control the coolant valve 50 by stopping the supply of the second coolant (S360). Then, the control unit 100 may determine whether the drying operation is completed (S370). If the drying operation is completed, the control unit 100 may terminate the supply of the second coolant.

If the drying operation is not finished, the control unit 100 may determine whether the fourth time period has elapsed, since the supply of the second coolant has stopped (S380).

The fourth time period is a time period shorter than the third time period by a predetermined time length. Here, new coolant would have the lowest temperature. If the second time period is shorter than the first time period A, the supply of second coolant may replace only a portion of the previously stored coolant. Accordingly, when the second time period is shorter than the first time period when the first time period and the second time period are the same. Thus, the supply of the second coolant replaces the previously stored coolant, the temperature of the coolant in the clearance or storage space 33 after the completion of the supply of the second coolant may be higher. Thus, when the second time period is shorter than the first time period, the third time period may be shorter than the first time period. Accordingly, the fourth time period may be shorter than the second time period.

If the fourth time period has elapsed, the control unit 100 may control the coolant valve 50 to supply the coolant to the storage unit for the second time period (e.g., the second coolant) again (S350). Then, the above-described subsequent processes may be repeated. If the second time period has not elapsed, the control unit 100 may wait for a predetermined time to determine whether the fourth time period has elapsed.

According to exemplary embodiments of FIG. 9, the first time period and the third time period may be pre-calculated and inputted by the user before the drying operation begins. The supplying of the coolant may be controlled to start or stop at a predetermined time in accordance with the inputted values of the first time period and the third time period. Accordingly, it may not be required to detect or measure a physical value related to the air or the coolant during the operation of the washing machine. Furthermore, calculating the timing for supplying the coolant during the operation of the washing machine may be unnecessary. Therefore, the drum type washing machine configured to perform the present method can be structured and controlled more simply, resulting in lowered manufacturing cost and improved durability.

The exemplary embodiments of FIG. 9 have been described for the examples where setting information such as the time period values, the flow rate of the air, the flow rate of the coolant, the temperature of the air, the first time period to the fourth time period, the first time period and the second time period are inputted through the input unit 110 or calculated by the time calculation unit 120. However, the present disclosure may not be limited thereto. By way of example, as stated above, the setting information may be inputted to the control unit 100 or the time calculation unit 120 by the manufacturer in the manufacturing process of the drum type washing machine 1 of the present disclosure, or may be previously stored in a storage device or unit accessible by the control unit 100 and loaded and used by the control unit 100 when necessary. Furthermore, the setting information may be modified by the user while the drum type washing machine of the present disclosure being used.

Although exemplary embodiments of the present disclosure are described above with reference to the accompanying drawings, those skilled in the art would understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims described below, not the detailed description, and it should be construed that all of changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A method for controlling a drum type washing machine including a condensing duct configured to receive air from a tub, the method comprising:

supplying a first coolant into a storage unit in the condensing duct, and holding or maintaining the first coolant in the storage unit; and supplying a second coolant into the storage unit after a preset or predetermined time period elapses, wherein the preset time period is shorter by a predetermined time length than an expected time period for thermal equilibrium between the coolant in the storage unit and the air in the condensing duct, wherein the method further comprises turning off a fan in a heating duct connected to one end of the condensing duct and the supplying the second coolant occurs after turning off the fan.

2. The method of claim 1, wherein the expected time period for thermal equilibrium is calculated from a temperature of the air in the condensing duct, a temperature of the coolant in the storage unit, a flow rate of the air in the condensing duct, a flow rate of the coolant supplied into the storage unit, a length of time during which the first coolant is supplied to the storage unit, and a specific heat of the coolant.

3. The method of claim 1, further comprising:

holding or maintaining the second the coolant in the storage unit; and resupplying the coolant to the storage unit after holding or maintaining the second coolant, wherein the second coolant or the resupplied coolant replaces at least a portion of the coolant previously in the storage unit.

4. The method of claim 3, wherein the second coolant is supplied for a time period shorter than a time period during which the first coolant is supplied.

5. The method of claim 3, wherein the coolant is resupplied for a time period shorter than a time period during which the first coolant is supplied.

6. The method of claim 1, wherein the condensing duct comprises an inner tube through which the air flows, and an outer tube surrounding at least a section of the inner tube.

7. The method of claim 6, wherein the storage unit comprises a space between the inner tube and the outer tube.

8. The method of claim 6, wherein supplying the first coolant occurs until the storage unit fills with the coolant.

9. The method of claim 6, wherein at least a portion of the first coolant overflows into the inner tube from the storage unit when the second coolant is supplied to the storage unit.

10. The method of claim 1, further comprising turning off a heater while the fan is turned off.

11. A method for controlling a drum type washing machine including a condensing duct having a partition wall that separates an air passage along which air from a tub flows, the method comprising:

supplying coolant to a storage unit in the condensing duct;

drying laundry in the washing machine for an initial preset time period during which a temperature of the coolant in the storage unit increases, and moisture in the air passage is condensed by heat transfer between the coolant and the air; and replacing at least a portion of the coolant in the storage unit with new coolant, wherein drying the laundry and replacing at least a portion of the coolant alternate, and a set time period for drying the laundry after replacing at least a portion of the coolant is equal to the initial set time period.

12. The method of claim 11, wherein the condensing duct is configured to be filled with coolant.

13. The method of claim 11, wherein the new coolant has a first volume less than a volume of the coolant in the initial supplying process.

14. The method of claim 11, wherein the set time period for drying the laundry after replacing at least a portion of the coolant is shorter than the initial set time period.

* * * * *